US009549652B2

(12) United States Patent
Hussey

(10) Patent No.: US 9,549,652 B2
(45) Date of Patent: Jan. 24, 2017

(54) STEAM CLEANING DEVICE AND ACCESSORY

(71) Applicant: BLACK & DECKER INC., New Britain, CT (US)

(72) Inventor: Christoher Hussey, Tyne and Wear (GB)

(73) Assignee: BLACK & DECKER INC., New Britain, CT (US)

( * ) Notice: Subject to any disclaimer, the term of this patent is extended or adjusted under 35 U.S.C. 154(b) by 0 days.

(21) Appl. No.: 14/934,378

(22) Filed: Nov. 6, 2015

(65) Prior Publication Data

US 2016/0128537 A1 May 12, 2016

(30) Foreign Application Priority Data

| | | |
|---|---|---|
| Nov. 7, 2014 | (EP) | 14192235 |
| Mar. 27, 2015 | (EP) | 15161306 |
| Oct. 28, 2015 | (EP) | 15191920 |

(51) Int. Cl.
*A47L 11/40* (2006.01)
*A47L 11/34* (2006.01)
(Continued)

(52) U.S. Cl.
CPC ..... *A47L 11/34* (2013.01); *A47L 11/4036* (2013.01); *A47L 11/4086* (2013.01); *A47L 13/18* (2013.01); *B08B 3/028* (2013.01); *B08B 2230/01* (2013.01)

(58) Field of Classification Search
CPC .. A47L 11/34; A47L 11/4036; A47L 11/4086; A47L 13/18; B08B 3/028; B08B 2230/01
See application file for complete search history.

(56) References Cited

U.S. PATENT DOCUMENTS 1,533,732 A * 4/1925 Livingstone ..... A47L 13/18 239/529
1,558,930 A * 10/1925 Schuck ..... A41D 19/0079 239/529
(Continued)

FOREIGN PATENT DOCUMENTS

| | | |
|---|---|---|
| EP | 2494901 | 9/2012 |
| GB | 2294196 | 4/1996 |

(Continued)

OTHER PUBLICATIONS

EP Search Report for Application No. 15191920.6 dated Mar. 22, 2016.

*Primary Examiner* — Dung Van Nguyen
(74) *Attorney, Agent, or Firm* — John Yun

(57) ABSTRACT

A steam cleaning accessory for use with a steam generator comprises a flexible body comprising a front wall, a rear wall and base extending there between. At least one steam conduit is connectable to the steam generator and is arranged to be in fluid communication therewith. The steam conduit comprises at least one steam outlet for ejecting steam. The at least one steam outlet is mounted on an underside of the base which is configured to be adjacent to a surface to be cleaned. A flexible pocket is mounted on the flexible body and arranged to receive a user's hand. A barrier projects from the flexible body which is engageable with the surface to be cleaned. The barrier is located on a rear wall side of the at least one steam outlet.

15 Claims, 10 Drawing Sheets

(51) Int. Cl.
*B08B 3/02* (2006.01)
*A47L 13/18* (2006.01)

(56) References Cited

U.S. PATENT DOCUMENTS

| | | | | |
|---|---|---|---|---|
| 2,261,064 | A | 10/1941 | Katz | |
| 2,578,188 | A | 4/1948 | Ionides et al. | |
| 2,759,278 | A | 3/1953 | Fray | |
| 3,793,753 | A | 2/1974 | Engelbart | |
| 5,091,243 | A | 2/1992 | Tolbert et al. | |
| 5,399,418 | A | 3/1995 | Hartmanns et al. | |
| 5,718,016 | A * | 2/1998 | Sung | A47L 5/24 15/227 |
| 5,749,120 | A * | 5/1998 | Amoretti | A47L 11/34 15/321 |
| 7,409,786 | B2 | 8/2008 | Lee | |
| 7,484,261 | B2 * | 2/2009 | Sigl | A47L 13/17 15/104.94 |
| 7,926,519 | B1 | 4/2011 | Wigent | |
| 8,459,273 | B2 * | 6/2013 | Silva | A45D 20/12 132/271 |
| 8,919,357 | B2 * | 12/2014 | Breit | B08B 3/00 134/105 |
| 2003/0157853 | A1 | 8/2003 | Huber | |
| 2012/0204375 | A1 * | 8/2012 | Charlton | A47L 11/4036 15/320 |

FOREIGN PATENT DOCUMENTS

| | | |
|---|---|---|
| JP | 2008011973 | 1/2008 |
| WO | 0243550 | 6/2002 |
| WO | WO0243550 | 6/2002 |

* cited by examiner

STEAM CLEANING DEVICE AND ACCESSORY

CROSS-REFERENCE TO RELATED APPLICATIONS

This application claims priority to European Patent Application No. 14192235.1 filed Nov. 7, 2014, and European Patent Application No. 15161306.4 filed Mar. 27, 2015 and European Patent Application No. 15191920.6 filed Oct. 28, 2015. The entire contents of that application are expressly incorporated herein by reference.

FIELD OF THE INVENTION

The present invention relates to a steam cleaning device and accessory.

BACKGROUND OF THE INVENTION

In recent times steam cleaning has become desirable in the domestic environment. A known steam cleaner is shown in EP2494901 which has a boiler for generating steam and a cleaning head for directing the steam to a surface to be cleaned. The cleaning head is designed to engage a floor surface. The size of the steam cleaner and the construction of the cleaning head means that it is difficult to clean surfaces other than the floor.

BRIEF SUMMARY OF THE INVENTION

One device for cleaning surfaces other than the floor is shown in WO02/43550. This shows a cleaning glove with ducts for receiving or delivering fluid to openings in the fingers and palm of the glove and the glove can be used with water or steam. A problem with the cleaning glove is that when the cleaning glove is used with steam the user is susceptible to being burnt by the steam.

A cleaning device which is convenient to use for indoor domestic tasks is desirable. Embodiments of the present invention aim to address the aforementioned problems.

In one aspect of the invention there is provided a steam cleaning accessory for use with a steam generator comprising: a flexible body comprising a front wall, a rear wall and a base extending there between; at least one steam conduit connectable to the steam generator and arranged to be in fluid communication therewith, wherein the steam conduit comprises at least one steam outlet for ejecting steam and the at least one steam outlet is mounted on an underside of the base which is configured to be adjacent to a surface to be cleaned; a flexible pocket mounted on the flexible body and arranged to receive a user's hand; and a barrier projecting from the flexible body which is engageable with the surface to be cleaned, the barrier being located on a rear wall side of the at least one steam outlet.

The steam cleaning accessory is conveniently wearable on the user's hand. Furthermore the steam cleaning accessory comprises a plurality of layers, each of which is flexible and one of the layers delivers and outputs steam. This makes a convenient and deformable steam cleaning accessory which outputs steam at a temperature which kills germs. In particular the steam cleaning accessory is convenient for sanitizing non-flat surfaces such as toilets, taps, shower heads and sinks.

The barrier limits or prevents the steam flow from moving backwards to the user's wrist. Instead the steam flow is directed the barrier and the steam is guided to other parts of the steam cleaning accessory such as the sides and the front of the steam cleaning accessory.

Preferably the barrier extends substantially across the width of the underside of flexible body. This means that the steam flow does not flow around the barrier and towards the user's wrist. Instead the steam must flow to the edge of the steam cleaning accessory by which point the surrounding air flow will disperse and cool the steam before it reaches the user's hand.

Preferably the barrier is integral with the flexible body. This means the construction of the steam cleaning accessory is similar. The barrier can also share the same thermal properties as the flexible body.

Preferably the barrier is arranged to be substantially aligned with the heel of a user's hand when the user's hand is received in the flexible pocket. This means that when the user wears the steam cleaning accessory and cleans a surface, the user will naturally push the barrier towards to be cleaned. This means that the space between the barrier and the surface to be cleaned will be limited and very limited steam will flow under the barrier.

Preferably barrier is arranged to seal against the surface to be cleaned. In this way the barrier prevents the steam from flowing to the user's wrist. However the barrier can form a partial seal or a full seal against the surface to be cleaned.

Preferably the barrier is made from silicone. This means that the barrier has good thermal insulating properties. Furthermore the barrier is deformable against uneven surfaces.

Preferably an adaptor in fluid communication with the at least one steam conduit and the adaptor is connectable with a steam hose or the steam generator and the adaptor is mounted on the flexible body on the rear wall side of the barrier.

Preferably the flexible body comprises a rearwardly projecting wrist guard. Preferably the wrist guard is integrally moulded with the flexible body. Preferably the wrist guard is between the adaptor and the opening of the flexible pocket. The wrist guard prevents a user's exposed wrist from being burnt from any steam that escapes from the steam outlet or from the adaptor in the steam cleaning accessory. For example if the adaptor is not seated correctly in the flexible body, the wrist guard will protect the user from the steam.

Preferably the steam cleaning accessory comprises a flexible insulating layer mounted between the base and the flexible pocket. The steam cleaning accessory is better thermally insulated and limits the transfer of thermal energy from the steam to the user's hand. Preferably the flexible insulating layer is a resilient air permeable material.

Preferably the steam cleaning accessory comprises a removable flexible cleaning element mountable on the flexible body. Preferably the removable cleaning pad comprises a retention strap for mounting around the barrier for retaining the removable cleaning pad to the flexible body.

In another aspect of the invention there is a steam cleaning device comprising; a steam generator and a steam cleaning accessory according to the aforementioned aspects of the invention.

BRIEF DESCRIPTION OF THE DRAWINGS

Various other aspects and further embodiments are also described in the following detailed description and in the attached claims with reference to the accompanying drawings, in which:

DETAILED DESCRIPTION OF THE INVENTION

Figure 1:
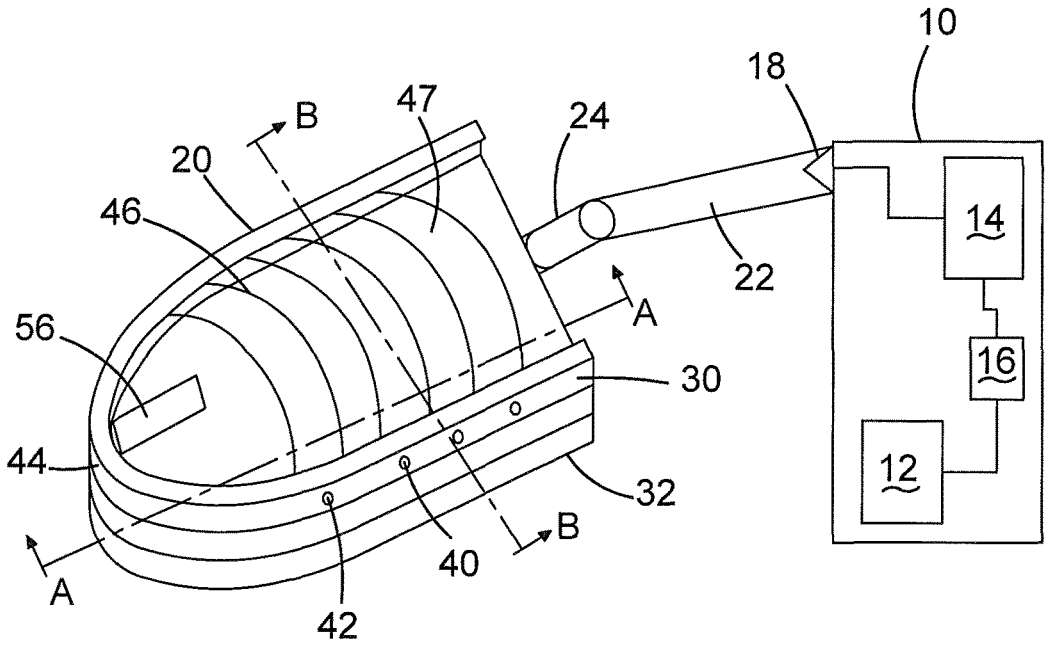
FIG. 1 shows a schematic representation of the steam cleaning device and accessory according to an embodiment.

FIG. 1 shows a schematic perspective view of a steam cleaning device 10. The steam cleaning device 10 comprises a water tank 12 and a steam generator such as a boiler 14. A pump 16 pumps water to the boiler 14. The boiler 14 comprises a resistive element and is powered by a source of electrical energy such as mains electricity or battery. Steam is generated by the boiler 14 and output at a steam nozzle 18 (or any other suitable steam outlet of the steam cleaning device 10).

The steam cleaning device 10 is coupled to a steam cleaning accessory 20 by a steam hose 22 and an adaptor 24. The adaptor 24 which is mounted on the steam cleaning accessory 20 and is arranged to couple the steam cleaning accessory 20 with the steam nozzle 18 such that the steam cleaning device 10 is in fluid communication with the steam cleaning accessory 20 via the steam hose 22.

The steam cleaning device 10 comprises a coupling for fixing the steam hose 22 to the steam nozzle 18. The steam hose 22 is detachable from the adaptor 24 allowing the steam cleaning device 10 to be used with other steam cleaning accessories. The steam cleaning device 10 is handheld and the steam cleaning accessory 20 is wearable on the other hand of the user. Of course, the user can also wear the steam cleaning accessory 20 without holding the steam cleaning device 10 at the same time. The steam hose 22 is of sufficient length such that the steam cleaning accessory 20 can be moved without constantly moving the steam cleaning device 10.

For example, in some embodiments the steam hose 22 is about 50 cm to 100 cm in length. This means that steam hose 22 is about the same length as a user's arm and the user can move the steam cleaning accessory 20 without moving the steam cleaning device 10 when held in the other hand.

Although not shown in FIG. 1, in some other embodiments the steam hose 22 is fixed to the steam cleaning accessory 20 and the adaptor 24 is mounted at the end of the steam hose 22. When the adaptor 24 is mounted at the end of the steam hose 22, the adaptor 24 couples the steam hose 22 to the steam nozzle 18.

Figure 2:
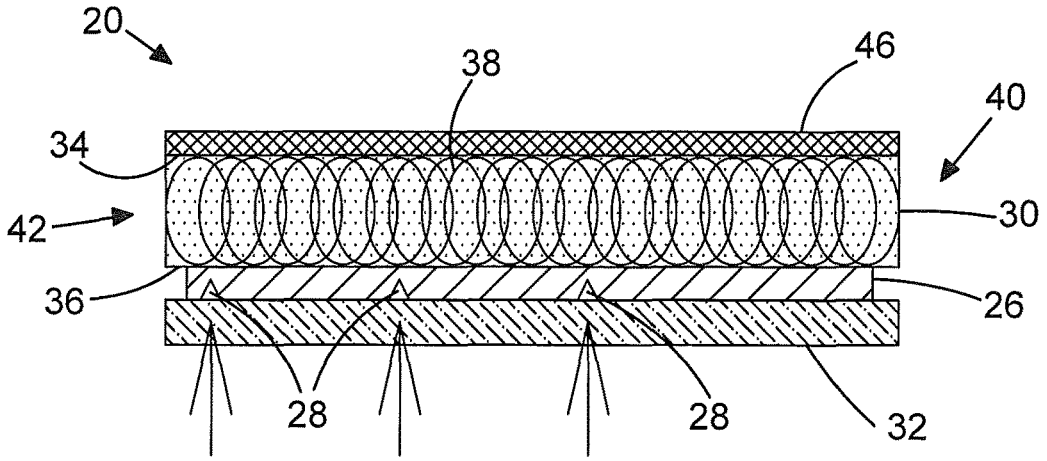
FIG. 2 shows a cross sectional side view of the steam cleaning accessory according to an embodiment.

The steam cleaning accessory 20 will now be described in more detail with reference to FIGS. 2 to 8. FIG. 2 shows a side cross sectional view of the steam cleaning accessory 20 along the line A-A in FIG. 1. The steam cleaning accessory 20 comprises a steam conduit or steam duct 26. The steam duct 26 is in fluid communication with the adaptor 24 and the steam cleaning device 10. The steam duct 26 in some embodiments is a silicone tube which extends over the steam cleaning accessory 20. The steam duct 26 comprises one or more steam outlets 28 for allowing steam to be released from the steam duct 26.

The steam duct 26 is mounted between a flexible thermal insulation layer 30 and a flexible cleaning element 32. Although not shown, the flexible cleaning element 32 is also fixed to the flexible thermal insulation layer 30. The flexible cleaning element 32 is steam permeable and the steam outlets 28 face the flexible cleaning element 32. The flexible cleaning element 32 is steam permeable by virtue that the flexible cleaning element 32 is a material which comprises holes for allowing steam to pass therethrough. In some embodiments the flexible cleaning element 32 is a fabric material such as a woven fabric material. The woven fabric material has holes between the threads and the holes allow the steam to pass through. Alternatively the flexible cleaning element 32 is a substantially non steam permeable material, but the flexible cleaning element 32 comprises through holes for allowing the passage of steam through the flexible cleaning element 32.

In some embodiments the flexible cleaning element 32 is a cleaning cloth which is suitable for wiping along dirty surfaces. In other embodiments the flexible cleaning element 32 can be one or more of the following, a cleaning element with bristles, brush, a scourer, sponge, pad or any suitable material for cleaning and wiping a dirty surface. Since the flexible cleaning element 32 is deformable, the flexible cleaning element 32 can be wrapped around curved surfaces such as taps, sinks and the like.

As mentioned above, the steam duct 26 is sandwiched between the flexible cleaning element 32 and the flexible thermal insulation layer 30. The flexible thermal insulation layer 30 is a barrier layer which limits the transmission of the thermal energy across the steam cleaning accessory 20. The flexible thermal insulation layer 30 can be any suitable thermal insulation layer which is flexible. For example in some embodiments the flexible thermal insulation layer 30 is a silicone layer.

In some alternative embodiments, and as shown in FIG. 2, the flexible thermal insulation layer 30 is a spacer fabric. The spacer fabric comprises a first layer 34 of fabric and a second layer 36 of fabric and the first and second layers are separated by at least one resilient thread 38 knitted therebetween. This means that the spacer fabric comprises an air inlet 40 and an air outlet 42 and an air flow pathway between the two. The air inlet 40 and the air outlet 42 can be located in any position on the flexible thermal layer 30 and there may be any number of air inlets 40 or air outlets 42. This means that the convection of air is increased around and through the flexible thermal insulation layer 30. In some embodiments the first layer 34 and the second layer 36 of the spacer fabric are a mesh or net like material and comprise a plurality of holes which promote air flow within the flexible thermal insulation layer 30.

The inventor has realised that a flexible thermal insulation layer 30 with at least one an air inlet 40 and an air outlet 42 with an air flow pathway between them is an effective way of preventing thermal energy building up in the steam cleaning accessory 20 from the continual use of the steam cleaning accessory 20. The embodiments discussed herein dissipate the thermal energy from the steam cleaning accessory 20 by convection of the surrounding air through the steam cleaning accessory 20.

In some other embodiments the flexible thermal insulation layer 30 comprises a foam material which comprises holes allowing air to pass therethrough. In other embodiments the thermal insulation layer 30 is a solid material such as a silicone layer with holes bored into the centre of the material for allowing air to circulate through the centre of the silicone layer.

Briefly turning to FIG. 1, the flexible thermal insulation layer 30 optionally comprises at least one of the air inlet 40 and the air outlet 42 in a peripheral side 44 of the steam cleaning accessory 20. By having air holes in the peripheral side 44 of the steam cleaning accessory 20, when the steam cleaning accessory 20 is moved from side to side, air from the external environment is encouraged to move along the air flow pathway. This means cool air from outside the steam cleaning accessory 20 replaces the warmer air within the flexible thermal insulation layer 30 each time the steam cleaning accessory 20 is moved from side to side. The air inlet 40 and the air outlet 42 can optionally be in alternative positions around the thermal insulating later 30.

A flexible retaining layer 46 is mounted on the flexible thermal insulation layer 30. The flexible retaining layer 46 is fixed to the side of the flexible thermal insulation layer 30 which is opposite to the side on which the steam duct 26 is mounted. The flexible retaining layer 46 in some embodiments is a flexible restraint for receiving the user's hand. The flexible restraint in some embodiments can be a flexible pocket 47. The flexible layer 46 creates a flexible pocket 47 between the retaining layer 46 and the flexible thermal insulation layer 30 in which the user can place their hand. When the user puts their hand in the flexible pocket 47, the flexible thermal insulation layer 30 and the retaining layer 46 deform around the hand. In this way the user is able to wear the steam cleaning accessory 20 in the same way they can wear a glove or a mitt. In use the user's palm is adjacent to the first fabric layer 34 of the flexible thermal insulation layer 30 and the back of the user's hand is adjacent to the flexible retaining layer 46. The flexible retaining layer 46 and the flexible pocket 47 allow the steam cleaning accessory 20 to be worn on the hand without physically gripping the steam cleaning accessory 20. This means the steam cleaning accessory 20 does not fall off the user's hand.

Optionally in some embodiments the retaining layer 46 is a mesh material or a net material. This provides air holes in the retaining layer 46 and increases the circulation of air around the user's hand which helps keep the user's hand cool.

In some embodiments the retaining layer 46 comprises an elasticated material which further grips the user's hand. The retaining layer 46 may also comprise one or more upstanding finger partitions 56 for separating a user's fingers. The finger partitions 56 aid the user's comfort when using the steam cleaning accessory 20. Optionally the retaining layer 46 may comprise a releasable cuff for wrapping around the user's wrist to help keep the steam cleaning accessory 20 on the user's hand.

The flexible restraint can be any suitable means for coupling the user's hand to the steam cleaning accessory 20. Alternatively the flexible restraint is one or more flexible straps which are mounted to the flexible thermal insulation layer 30. The flexible straps (not shown) pass over the back of the user's hand and/or wrist.

Figure 3:
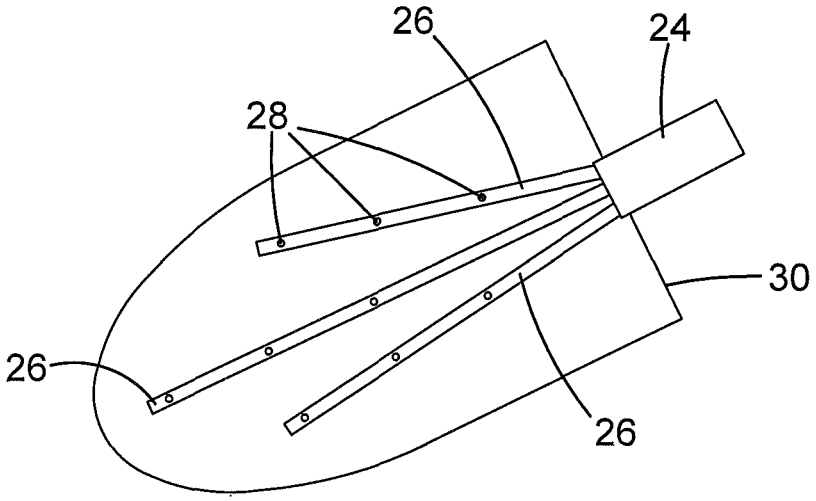
FIG. 3 shows a schematic representation of a partial view of the steam cleaning accessory.

The distribution of the steam duct 26 will now be discussed in further detail to FIG. 3. FIG. 3 shows an underneath plan view of part of the steam cleaning accessory 20. In particular FIG. 3 shows three steam ducts 26 mounted on the flexible thermal insulating layer 30. Each steam duct 26 is in fluid communication with the adaptor 24 and the steam cleaning device 10. The plurality of steam ducts 26 each comprises at least one steam outlet 28. FIG. 3 shows that each steam duct 26 has a plurality of steam outlets 28. The steam cleaning accessory 20 can have any number of steam ducts 26 and the steam ducts 26 can follow any path over the flexible thermal insulation layer 30.

Figure 4:
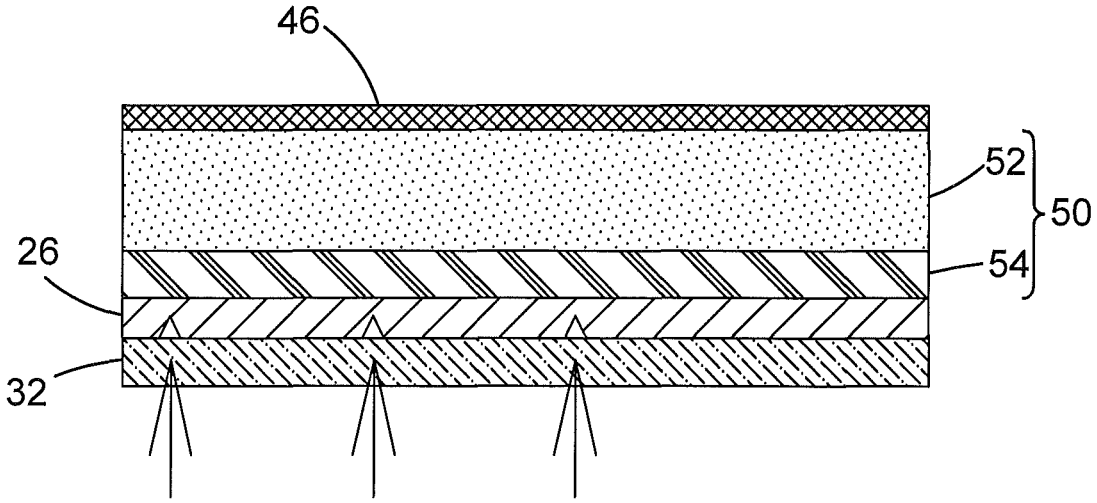
FIG. 4 shows a cross sectional side view of the steam cleaning accessory according to an embodiment.

Further embodiments will now be discussed in reference to FIG. 4. FIG. 4 shows a cross sectional side view of the steam cleaning accessory 20. The steam cleaning accessory 20 is similar to the embodiments discussed in reference to FIGS. 1 to 3. The same reference numbers will be used for the same features in previously mentioned embodiments. FIG. 4 differs in that the flexible thermal insulation layer 50 comprises a first flexible thermal insulation layer 52 and a second flexible thermal insulation layer 54. The first flexible thermal insulation layer 52 is the same as the flexible thermal insulation layer 30 in the embodiments described with respect to FIGS. 1 to 3. The second flexible thermal insulation layer 54 is a solid flexible layer on which the steam duct 26 is mounted. By separating the flexible thermal insulation layer 50 in to two different parts, a thinner composite material can be achieved. The solid flexible layer 54 is non-woven and reduces the amount of heat radiated from the steam ducts 26 to the user's hand. The second flexible layer can be a flexible layer of silicone. The first flexible thermal insulation layer 52 is thinner compared to the thermal insulation layer 30 in the embodiment discussed in FIG. 3. The boundary layer between the first and second layers 52, 54 also reduces the amount of thermal energy conducted through the materials.

By providing a silicone layer 54 or another non-woven thermally insulating material, the steam duct 26 is more easily bonded and fixed in place. In some embodiments the silicone tubes used for the steam duct 26 are bonded to the silicone layer 54 with a silicone based adhesive. In some other embodiments the silicone tube 26 and the silicone layer 54 are partially cured. During manufacture the partially cured silicone tubes 26 are placed in position on the partially cured silicone layer 54 and the arrangement is exposed to an elevated temperature. This cures both the silicone tube 26 to the silicone layer 54 which are both bonded to each other without the need for adhesive. In some other embodiments the steam duct 26 can be integral with the silicone layer 54. For example the steam duct 26 can be an embedded tube in the silicone layer. Alternatively the steam duct 26 can be an internal bore moulded within the silicone layer. The internal bore can be completely embedded within the silicone layer, an open channel in the underside of the silicone layer or a combination of an internal bore and an open channel.

Figure 5:
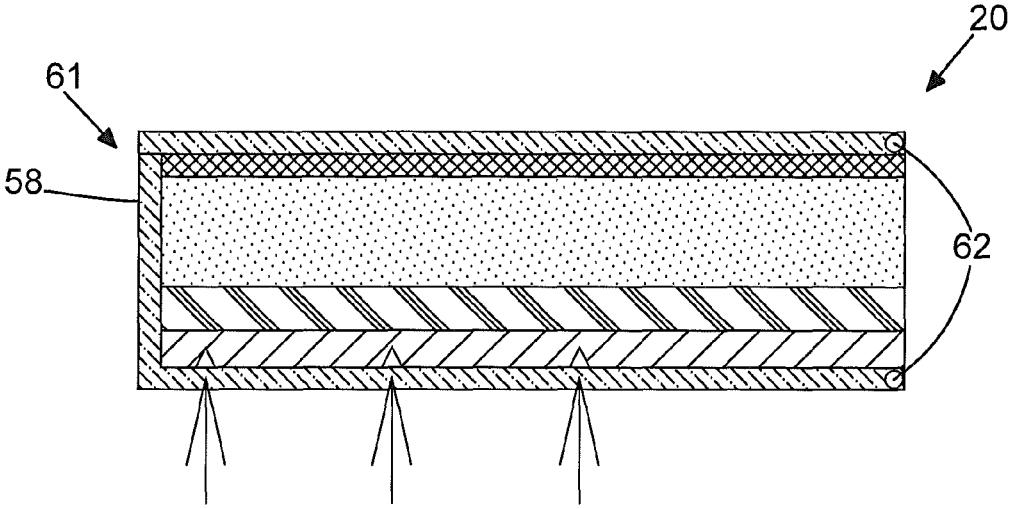
FIG. 5 shows a cross sectional side view of the steam cleaning accessory according to an embodiment.

Turning to FIG. 5 another embodiment of the steam cleaning accessory 20 will now be discussed. The steam cleaning accessory 20 is similar to the embodiment discussed with reference to the embodiments shown in FIG. 4 and the same reference numbers will be used to indicate the same features. FIG. 5 differs in that the flexible cleaning element 32 is removable and replaceable. The flexible cleaning element 32 as shown in FIG. 5 is a replaceable cleaning sock 58 which covers the entire steam cleaning accessory 20. The cleaning sock 58 is made from the same material as the flexible cleaning element 32 as discussed in reference to the embodiments of FIGS. 1 to 4. The opening of the cleaning sock 58 has an elasticated band 62 or a draw string for fastening the cleaning sock 58 to the steam cleaning accessory 20. In some alternative embodiments, the cleaning sock 58 has a pocket portion (not shown) in which the finger end 61 of the steam cleaning accessory 20 is inserted and the cleaning sock 58 is fastened to the steam cleaning accessory 20 at the other end. The replaceable cleaning sock 58 can be used in conjunction with any of the other embodiments discussed herein.

Figure 6:
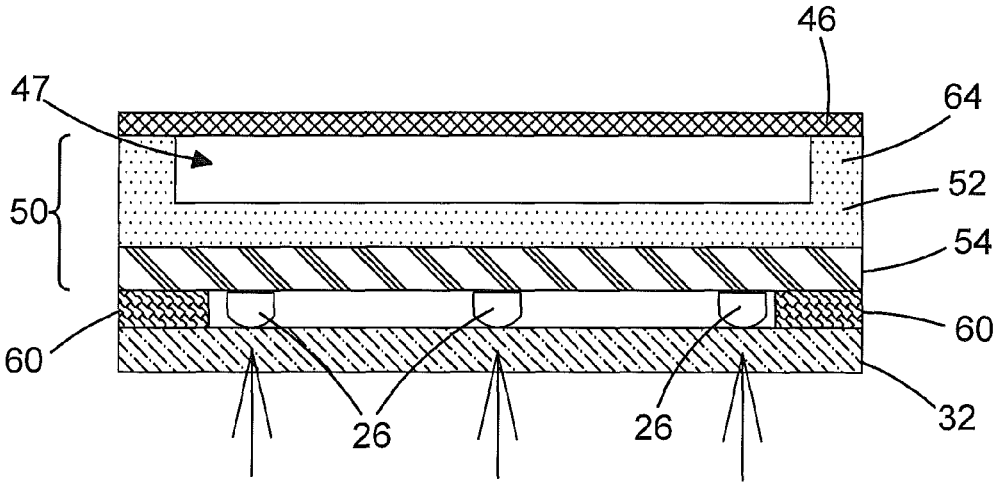
FIG. 6 shows a cross sectional front view of the steam cleaning accessory according to an embodiment.

FIG. 6 shows a front cross sectional view of the steam cleaning accessory 20 as view along cross section B-B. The steam cleaning accessory 20 is the same as the steam cleaning accessory 20 as shown in FIG. 4 and the same reference numbers will be used accordingly. The flexible cleaning element 32 is removably mounted on the second flexible thermal insulation layer 54. The flexible cleaning element 32 is fastened to the second flexible thermal insulation layer 54 with a hook and eye arrangement 60 (e.g. VELCRO®). Alternatively any suitable fastening means can be used to removably fasten the cleaning element 32 to the second flexible thermal insulation layer 54. For example clips or screws could be used instead. Removably attaching the flexible cleaning element 32 to the thermal insulation layer 50 may be optionally used in conjunction with any of the other embodiments discussed herein.

The steam ducts 26 are mounted on the second flexible thermal insulation layer 54. The steam ducts 26 project down from the second flexible thermal insulation layer 54. Flexible infill material (not shown) may be located between the steam ducts 26 so that the flexible cleaning element 32 e.g. a cloth does not wrinkle or crease around the steam ducts 26. Optionally the steam ducts 26 have a "D-shaped" cross section with the flat side adjacent to the second flexible thermal insulation layer 54. The flat surface of the steam duct 26 allows the steam ducts 26 and the steam outlets 28 to be aligned before bonding to the second flexible thermal insulation layer 54. This means that the steam outlets 28 are less likely to be pointing in the wrong direction, for example towards the user's hand because the flat surface limits rotation of the steam duct 26 during manufacture.

The first layer 52 of the flexible thermal insulation layer 50 may optionally comprise an upstanding peripheral wall 64. The upstanding peripheral wall 64 substantially encircles the user's hand. This means that the peripheral wall 64 defines an interior recess which increases the size of the pocket 47. The peripheral wall 64 also helps the user's hand remain engaged with the steam cleaning accessory 20 in a central position when wiping surfaces. In other words the peripheral wall 64 gives the user something to push against when wiping the steam cleaning accessory 20 from side to side.

Figure 7:
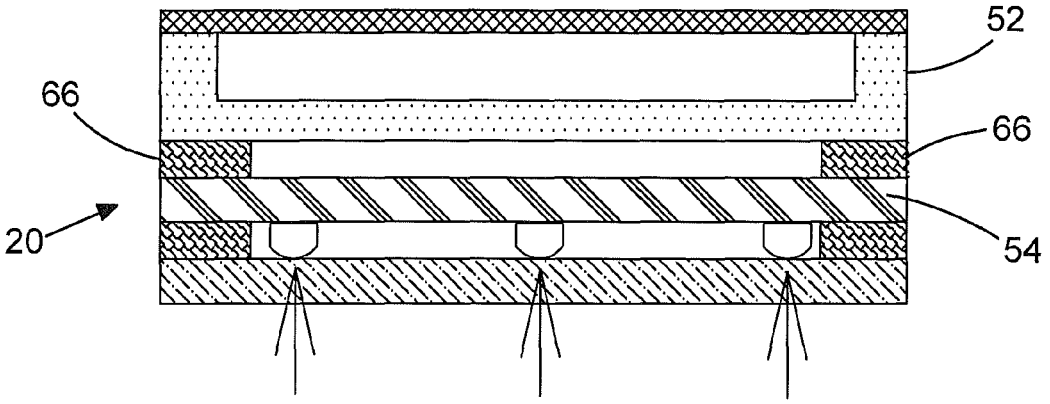
FIG. 7 shows a cross sectional front view of the steam cleaning accessory according to an embodiment.

FIG. 7 shows a front cross sectional view of another embodiment of the steam cleaning accessory 20. FIG. 7 shows a similar steam cleaning accessory 20 as shown in FIG. 6. FIG. 7 differs from FIG. 6 in that the second flexible thermal insulation layer 54 is removable from the first flexible thermal insulation layer 52. The first and second layers 52, 54 are coupled to each other by a hook and eye fastening arrangement 66 (e.g. VELCRO®). Any other suitable fastening means can be used to fasten the first and second flexible thermal insulation layers together 52, 54. By making the first and second layers flexible thermal insulation 52, 54 separable, the first flexible thermal insulation layer 52 can be washed independently of the steam ducts. Removably attaching the first and second thermal insulation layers 52, 54 may be optionally used in conjunction with any of the other embodiments discussed herein.

Figure 8:
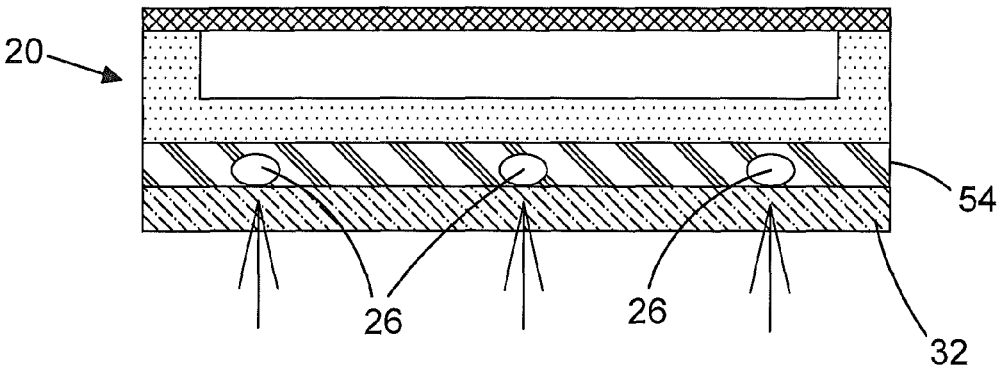
FIG. 8 shows a cross sectional front view of the steam cleaning accessory according to an embodiment.

Another embodiment of the steam cleaning accessory 20 will now be discussed in reference to FIG. 8. FIG. 8 shows a front cross sectional view of the steam cleaning accessory 20. The steam cleaning accessory 20 of FIG. 8 is similar to the steam cleaning accessory 20 described with reference to the previous embodiments. The difference is that the steam ducts 26 are embedded or partially embedded in the second flexible thermal insulation layer 54. This means that the flexible cleaning element 32 sits flush on the second flexible thermal insulation layer 54. Alternatively the steam ducts 26 may comprise integral bores completely within the second flexible thermal insulation layer 54 for providing a flow pathway for the steam. Alternatively the steam ducts 26 can be an open channel in the second flexible thermal insulation layer 54 or a combination of an internal bore and an open channel.

In another embodiment, not shown, the steam conduit is a bladder formed from two pieces of steam impermeable material bonded together. The bladder comprises a plurality of holes for releasing the steam towards the flexible cleaning element 32, similar to the previously discussed embodiments. The steam fills up the bladder and creates a steam reservoir within the steam cleaning accessory 20. In some embodiments the bladder can also form the second flexible thermal insulation layer 54. Alternatively, the bladder is formed from a single piece of material having a balloon-like construction.

Figure 9:
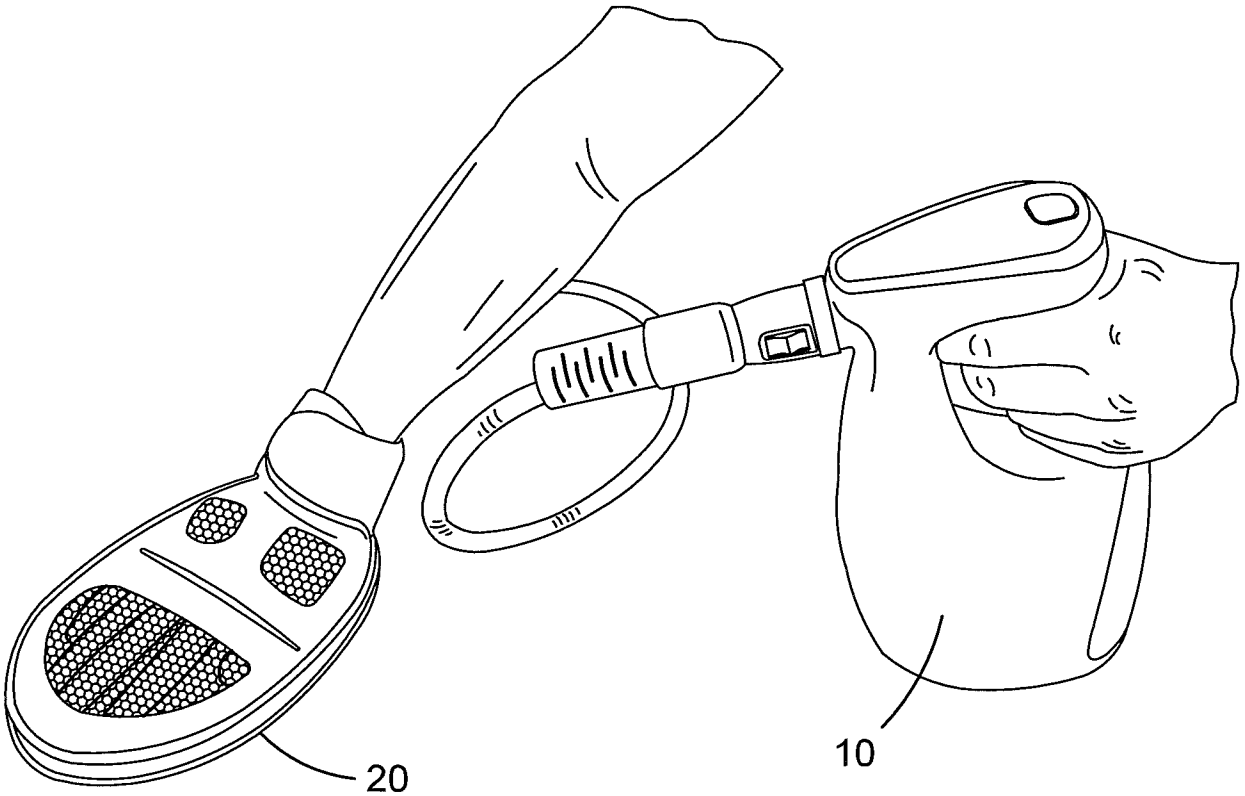
FIG. 9 shows a picture of the steam cleaning device and accessory in use.

Use of the steam cleaning accessory 20 will now discussed in reference to FIG. 9. FIG. 9 shows a photo of the steam cleaning device 10 which is held in the hand and the steam cleaning accessory 20 worn on the other hand. The steam cleaning device 10 generates steam and this flows through the steam ducts 26 and out of the steam outlets 28. The flexible thermal insulation layer 30 stops the user's hand getting hot or burnt. Since the entire steam accessory 20 is flexible, the steam accessory 20 can be deformed, bent and moulded according to the position of the user's hand. The steam cleaning accessory 20 will deform and bend around curved surfaces allowing the user to achieve a steam clean. This is particularly advantageous when cleaning toilets, showerheads, taps and sinks.

The steam cleaning device 10 may comprise a small boiler 14 which delivers between 5 ml/min to 30 ml/min of steam to the steam cleaning accessory 20. In some embodiments the boiler 14 generates 15-20 ml/min of steam. It is thought that 15-20 ml/min of steam will provide enough steam to the steam cleaning accessory 20 to achieve germ kill.

In some alternative embodiments (not shown) the steam cleaning accessory 20 comprises a first portion for one or more digits and a second portion for one or more digits. The first and second portions are independently movable with respect to each other. The first and second portions comprises a split therebetween which provides a receiving space. Each layer comprises the first and second portions such that the first and second portions each respectively operates as a steam cleaning accessory 20. The first and second portions may each comprise a steam duct 26. Alternatively the steam duct 26 may optionally not extend into the first and second portion, but only extend into an area adjacent to the user's palm.

The receiving space is configured to accommodate a surface to be cleaned. In some embodiments the first portion is a thumb portion for receiving the thumb and the second portion is a finger portion for receiving one or more fingers. The thumb portion is spaced apart from the finger portion due to the natural hand shape. The receiving space is located between the thumb portion and the finger portion and is suitable for wrapping around pipes or other elongate objects. This means steam cleaning can be achieved on a round pipe more easily. In a further embodiment there is a plurality of splits in the steam cleaning accessory 20. This means that the steam cleaning accessory 20 can be a glove having from three to five separate portions, each configured to operate as a steam cleaning accessory 20.

In another embodiment (not shown), the steam cleaning accessory 20 comprises a flexible restraint for receiving less than five digits of a user's hand. For example the flexible restraint is sized only to receive two fingers (e.g. the index and the middle fingers). In other respects, the steam cleaning accessory 20 is the same as the steam cleaning accessories 20 as described in reference to the previously discussed embodiments. This means that a flexible restraint only receiving two fingers can be smaller and this means the steam cleaning accessory 20 allows more detailed and precise cleaning.

Figure 10:
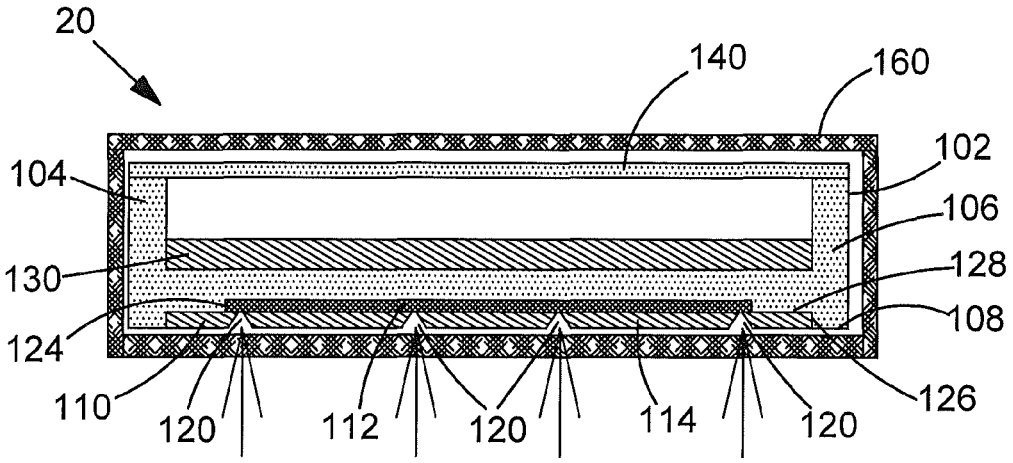
FIG. 10 shows a cross sectional front view of the steam cleaning accessory according to an embodiment.

FIG. 10 shows a cross sectional front view of the steam cleaning accessory 20 according to another embodiment. The steam cleaning accessory 20 is a modification of the previously described embodiments. The steam cleaning accessory 20 comprises a flexible sheath or flexible body 102. The flexible sheath 102 or flexible body 102 comprises a first side wall 104, a second side wall 106 and a base portion 108 therebetween. The flexible sheath or flexible body 102 provides a structure for holding and retaining parts of the steam cleaning accessory 20. The first and second side walls 104, 106 and the base 108 may be integral and formed from the same element. In other embodiments the side walls, 104, 106 and the base 108 can be separate elements which are bonded together.

In some embodiments the flexible sheath 102 is a single element and is moulded in a single shot process. The flexible sheath 102 is formed from a heat resistant silicone material.

The steam cleaning accessory 20 comprises a steam conduit 110. The steam conduit is at least one steam bladder 110 which is in fluid communication with the steam generator as described in previous embodiments. Although not shown, the steam cleaning accessory 20 is coupled to the steam generator 14 with a hose 22 which may or may not have an adaptor 24 for coupling to the steam generator 14 and/or the steam cleaning accessory 20. The steam bladder 110 comprises at least one steam outlet 120. The steam outlets 120 are one or more holes in the outer flexible layer 114. The steam bladder 110 comprises an inner flexible layer 112 and an outer flexible layer 114. The inner flexible layer 112 is mounted and bonded to the base 108. The outer flexible layer 114 comprises at least one steam outlet 120. The steam outlets 120 face away from the base 108 and direct the steam away from the steam cleaning accessory 20. In an alternative embodiment, the at least one conduit is a tube or other such means such as an open channel integral with the flexible body 102 for transmitting steam as mentioned in reference to the previous embodiments. The at least one conduit is mounted on or in the flexible sheath 102.

Figure 11:
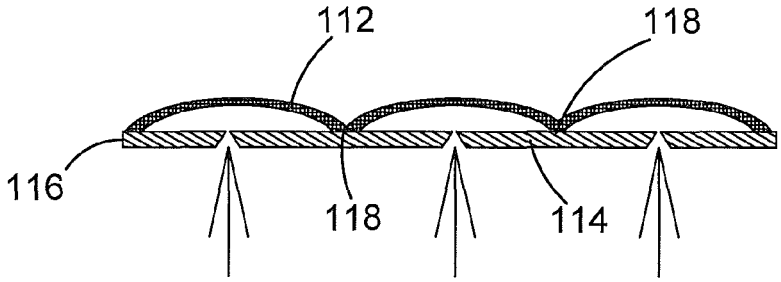
FIG. 11 shows a close up schematic view of the steam bladder according to an embodiment.

The inner flexible layer 112 and the outer flexible layer 114 are shown in more detail in FIG. 11. FIG. 11 shows a schematic view of the steam bladder 110. The inner and outer flexible layers 112, 114 are substantially bonded together around the periphery 116 of the steam bladder 110. The inner and outer flexible layers 112, 114 are optionally further bonded together at points 118 between the peripheral edge 116 of the steam bladder 110. In some embodiments the inner and outer flexible layers 112, 114 are bonded together with silicone adhesive.

Figure 13:
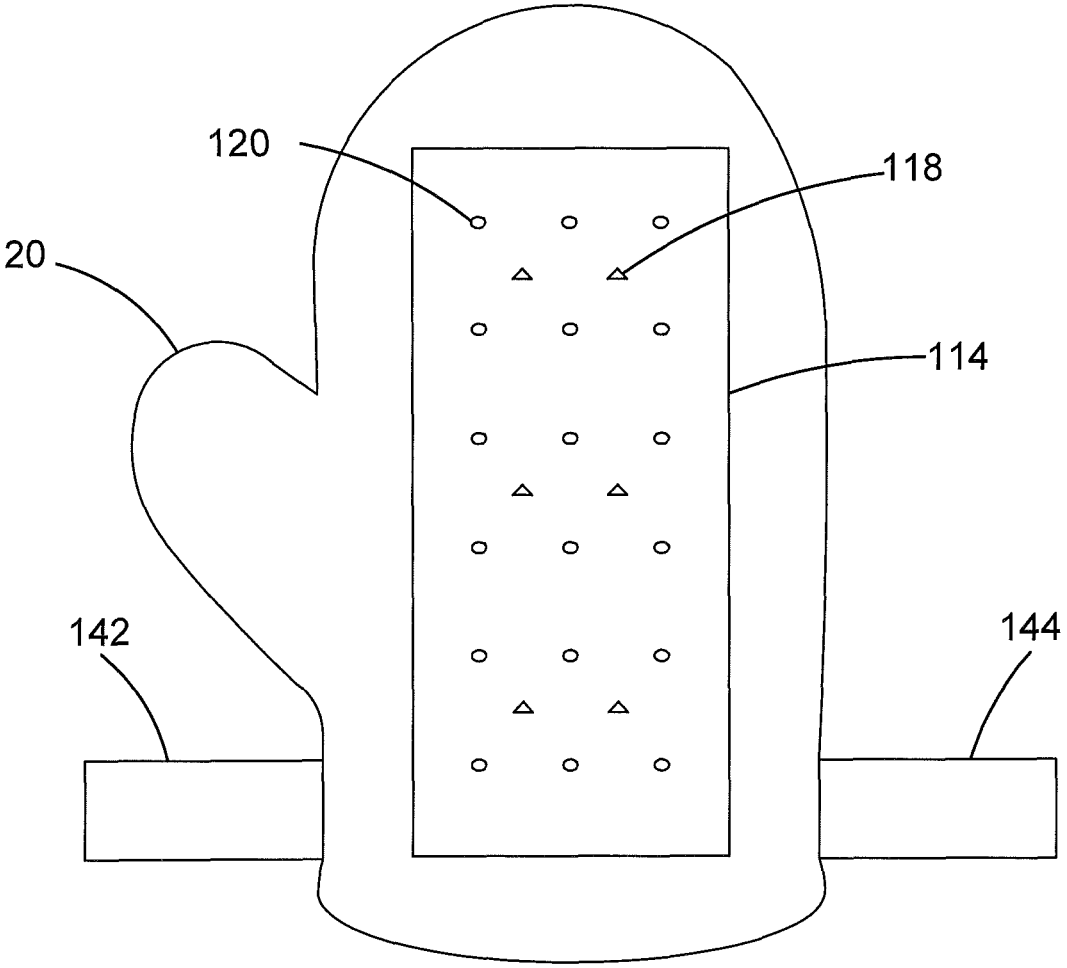
FIG. 13 shows a schematic plan view of the steam cleaning accessory according to an embodiment.

By bonding the flexible layer 112 and the outer flexible layer 114 at intermediate points 118, expansion of the steam bladder 110 when it fills with steam can be controlled. In particular the steam bladder 110 is prevented from swelling into a spherical shape which is difficult for a user to control in use. The intermediate points 118 can be a plurality of spot bonding sites. Turning to FIG. 13, which shows a schematic plan view of the steam cleaning accessory 20, the location of the intermediate bonding sites 118 will be discussed in further depth. The intermediate bonding sites 118 are shown as triangles and steam outlets 120 are shown as circles in FIG. 13. The intermediate bonding sites 118 can be spots as shown in FIG. 13. In this case the steam bladder 110 provides one reservoir of steam in use. Alternatively the steam bladder 110 can be divided into a plurality of sub-bladder portions which are separate from each other (not shown). The steam bladder 110 is subdivided by bonding the inner and outer flexible layers 112, 114 along continuous lines.

Turning back to FIG. 10, the steam bladder 110 is mounted in a recess 124 in the flexible sheath 102. The recess 124 accommodates the steam bladder 110 such that when the steam bladder 110 is mounted in the recess 124, the steam bladder 110 is flush with the underside of the base 108. In some embodiments the outer flexible layer 114 of the steam bladder 110 has a greater surface area that the inner flexible layer 112 of the steam bladder. This means that a portion 126 of the outer flexible layer 114 projects beyond the inner flexible layer 112. The projecting portion 126 provides a surface of material such that the steam bladder 110 can be bonded to a shoulder surface 128 of the recess 124. By sandwiching the base 108 between the flexible thermal insulation layer 130 and the steam bladder 110, there is an additional steam impermeable layer (the base 108) between the steam bladder 110 and the user's hand.

In some alternative embodiments the recess 124 can be replaced with a window (not shown) and the steam bladder 110 can be located within the window. A window may be preferable in order to save material costs during manufacture.

In other embodiments the steam bladder 110 can be formed from identical sized inner and outer flexible layers 112, 114. Alternatively the steam bladder 110 can be a balloon formed from a single piece of material. A steam bladder 110 is preferable to tubes as described in the previous embodiments because the tubes are difficult to locate and adhere to the steam cleaning accessory 20. By using two portions of silicone material for the steam bladder, the steam outlets 120 can accurately be made in the outer flexible layer 114 and then bonded to the inner flexible layer 112. This means that the inner flexible layer 112 can be kept away from the sharp tools when the steam outlets 120 are created in the outer flexible layer 114. This reduces the likelihood of the inner flexible layer 112 being punctured during manufacture. Advantageously, this means that the steam bladder 110 is less likely to leak steam in the direction of the user's hand.

A flexible thermal insulation layer 130 is mounted on an interior surface of the flexible sheath 102. The flexible thermal insulation layer 130 is the same as the thermal insulation layer described in reference to previous embodiments. Advantageously the flexible sheath 102 can be bonded to the flexible thermal insulation layer 130 along the inside surface of the base 108 and the inside surface of the first and second side walls 104, 106. This means that the edge of the fabric flexible thermal insulation layer 130 can be hidden and bonded to the flexible sheath without exposed scratchy edges which can irritate the user's skin. The side walls 104, 106 of the flexible sheath can constrain and hold the flexible thermal insulation layer 130. Furthermore moulding side walls 104, 106 from the flexible sheath 102 is easier than stitching or gluing walls created from the flexible thermal insulating material as described above in previous embodiments. In this way the manufacturing of the steam cleaning accessory 20 is quicker and simpler.

The steam cleaning accessory 20 further comprises a flexible pocket or restraint 140 coupled to the flexible sheath 102. Similarly to previous embodiments the restraint is arranged to couple to the user's hand and ensure the hand is located in the steam cleaning accessory 20. The restraint 140 can be the same as in previous embodiments. Additionally or alternatively, the restraint 140 may be integral with the flexible sheath 102. The restraint may be flexible and comprise a silicone material. FIG. 13 shows the restraint optionally comprising two halves 142, 144 which couple together and wrap around the user's wrist.

The steam cleaning accessory 20 comprises a flexible cleaning element 160 is removably mountable adjacent to the at least one steam outlet 120. The flexible cleaning element 160 in some embodiments is identical to the flexible cleaning element as described in reference to the previous embodiments. The flexible cleaning element 160 as shown in FIG. 10 is a fabric sock 160 which can be placed and secured over the steam cleaning accessory 20. After use, the fabric sock 160 can be removed for separate cleaning.

Figure 12:
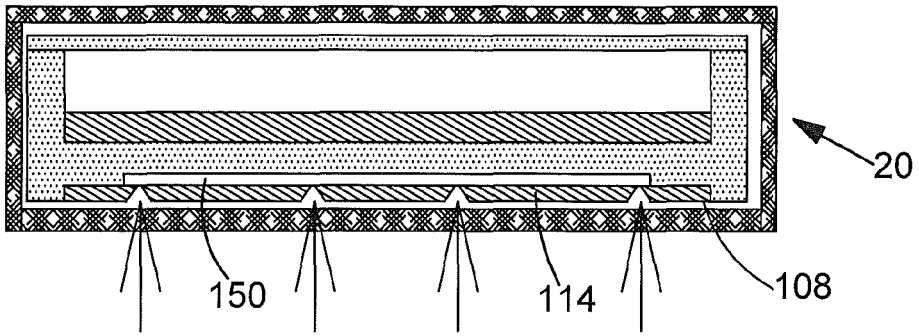
FIG. 12 shows a cross sectional front view of the steam cleaning accessory according to an embodiment.

Turning to FIG. 12 a further embodiment will be discussed. FIG. 12 shows a cross sectional front view of the steam cleaning accessory 20 according to another embodiment. The steam cleaning accessory 20 as shown in FIG. 12 is the same as in FIG. 10 except that the outer flexible layer 114 is bonded directly to the base 108. A void 150 is located between the outer flexible layer 114 and forms a steam reservoir for the steam bladder 110 during use.

Figure 14:
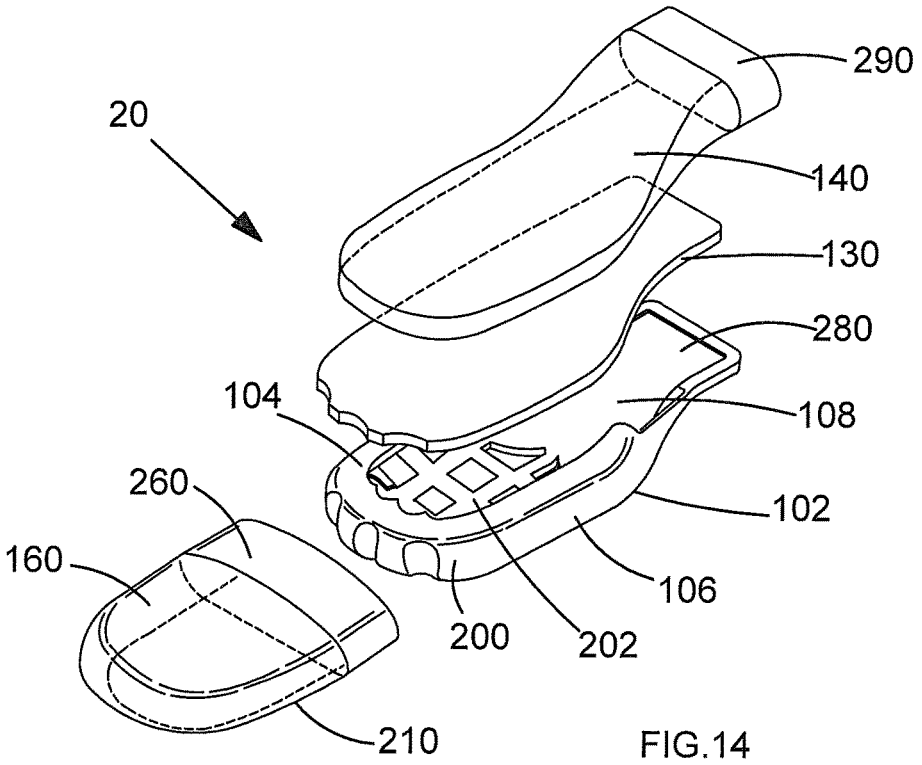
FIG. 14 shows an exploded perspective view of the steam cleaning accessory according to an embodiment.

Further embodiments will be discussed in reference to FIGS. 14 to 17. FIG. 14 discloses an exploded perspective view of another embodiment of the steam cleaning accessory 20. The same reference numbers will be used when referring to the same features as mentioned in the previous embodiments.

The steam cleaning accessory 20 as shown in FIG. 14 comprises a flexible sheath or flexible body 102. Similar to the previous embodiments the flexible body 102 is an integral silicone element which can be moulded in a single step. The differences between the flexible body 102 and the previous embodiments will be discussed hereinafter. By making the flexible body 102 from silicone, resistance against steam, vapour and hot water can be provided. The silicone material also is water proof and can prevent against steam and water ingress.

The flexible body 102 comprises the first side wall 104, the second side wall 106 and the base portion 108 extending therebetween. The first side wall 104 and the second side wall 106 as shown in FIG. 14 are integral and are in fact part of the same peripheral wall 200. The peripheral wall 200 is upstanding around the base portion 108 and defines a receiving space 202 for receiving the flexible thermal insulation layer 130. The flexible thermal insulation layer 130 is mounted on the flexible body 102 in the receiving space 202. The flexible thermal insulation layer 130 is the same as in the previous embodiments and its form and function will not be discussed in any further detail.

A flexible restraint means such as a flexible pocket 140 is mounted on the flexible body 102 and the flexible thermal insulation layer 130 is sandwiched between the flexible pocket 140 and the flexible body 102. Both the flexible pocket 140 and the flexible thermal insulation layer 130 are mounted within the receiving space 202 defined by the peripheral wall 200. The flexible restraint optionally comprising two halves 142, 144 forming a wrist strap which couple together and wrap around the user's wrist. The wrist strap can optionally be integral with the flexible body 102.

A flexible cleaning element 160 is mounted over the flexible body 102, the flexible thermal insulation layer 130 and the flexible pocket 140. The flexible cleaning element 160 is similar to the flexible cleaning elements discussed in respect of the previous embodiments. The flexible cleaning element 160 comprises a cleaning pad 210 only on the underside of the steam cleaning accessory 20. Optionally, the flexible cleaning pad 210 can cover all or a portion of the flexible body 102. The flexible cleaning pad 210 can cover a portion of the base 108 or all of the base 108. Likewise the flexible cleaning pad 210 can cover all or a portion of the side walls 104, 106 or the top of the steam cleaning accessory 20. In the embodiment shown in FIG. 14 the flexible cleaning pad 210 covers a front portion 236 (about half) of the underside of the steam cleaning accessory 20.

Figure 15:
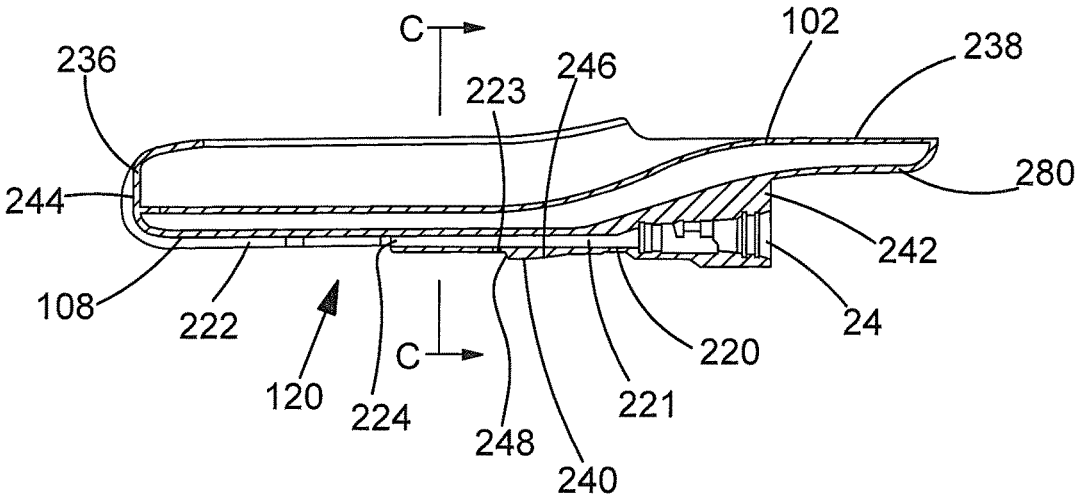
FIG. 15 shows a side cross sectional view of the steam cleaning accessory according to an embodiment.

FIG. 15 shows a cross sectional side view of the flexible body 102. For the purposes of clarity the flexible thermal insulation layer 130, the flexible pocket 140 and the flexible cleaning element 160 have not been shown. The flexible body 102 comprises an adaptor 24. The adaptor 24 comprises a moulded void and the adaptor 24 is inserted into the void. The adaptor 24 is configured to be connected to a steam hose 22 or directly to a steam generator such as a boiler 14. Alternatively, the flexible body 102 does not have an adaptor 24 and the steam hose 22 or the steam generator 14 and the steam cleaning accessory 20 form a unitary element.

The adaptor 24 receives steam from the steam generator 14. The adaptor 24 is in fluid communication with at least one steam conduit 220 which is coupled to at least one steam outlet 120 for ejecting steam. The steam conduit 220 comprises two portions: an internal bore portion 221 and an open channel portion 222. FIG. 15 shows a first steam hole 223 which is located part way along an internal bore portion 221 and a second steam hole 224 at the end of the internal bore portion 221. The internal bore portion 221 is completely housed within the flexible body 102. The open channel portion 222 comprises a matrix of open channels for channeling the steam to different parts of the flexible cleaning element 160. In some embodiments the steam conduit 220 comprises an open channel portion 222 or an internal bore portion 221 or a combination of both.

The first (or primary) steam hole 223 is located in the centre of the base 108 of the flexible body 102. The first steam hole 223 and the orientation of the internal bore 221 directs steam in a path of least resistance towards the front portion 236 of the steam cleaning accessory 20. The second (or secondary) steam hole 224 ensures that some steam is outputted towards the read of the flexible cleaning pad 210. The second steam hole 224 acts as a steam vent for steam to escape if the first steam hole 223 is restricted during operation (for example the user attempts to clench their first whilst using the steam cleaning accessory 20).

Figure 16:
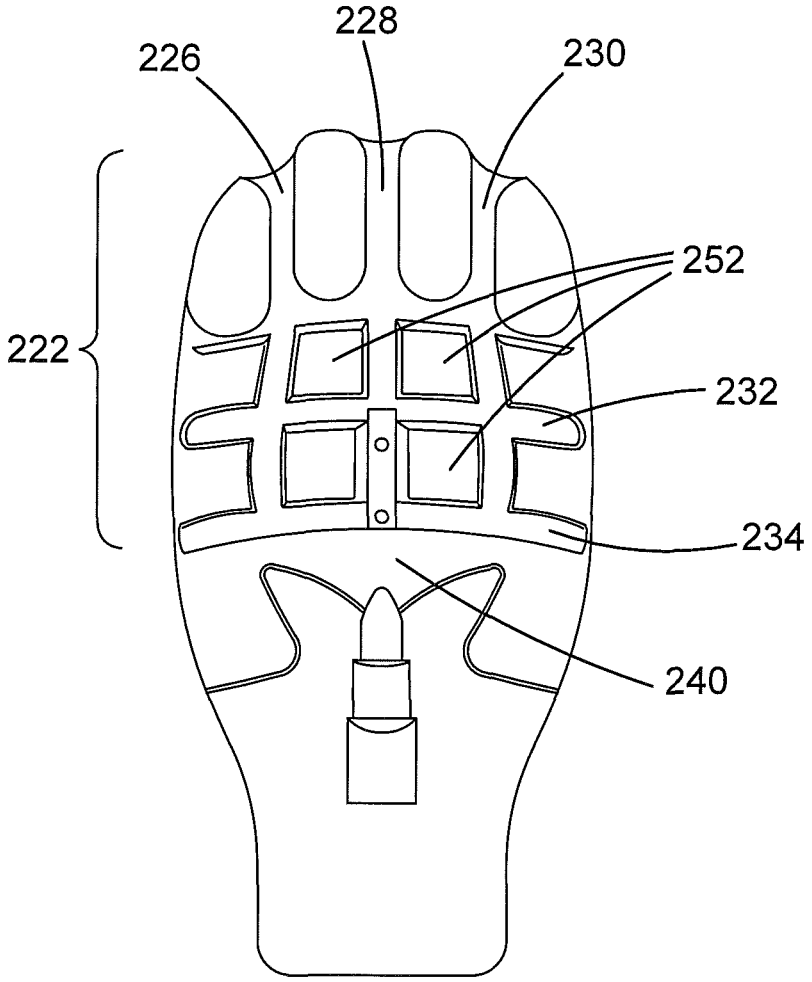
FIG. 16 shows an underneath view of the steam cleaning accessory according to an embodiment.

Turning to FIG. 16, which shows the steam cleaning accessory 20 from the underside, the open channel portion 222 will be described in further detail. The open channel portion 222 comprises a distribution of three longitudinal open channels 226, 228, 230 which are substantially parallel with the longitudinal axis of the steam cleaning accessory 20 and a distribution of two transverse open channels 232, 234 which are substantially perpendicular to the longitudinal axis. Alternatively the flexible body 102 can have any number or arrangement of open channels for guiding the steam. For example the flexible body 102 could have a single open channel (not shown) in fluid communication with the internal bore portion 221.

The matrix of open channels provides a plurality of pad supports 252. The pad supports 252 abut against the flexible cleaning pad 210 during use and maintain the pad at a desired position with respect to the base 108. This means that pad supports 252 allow the flexible cleaning pad 210 to lay across the top of the open channels 226, 228, 230, 232, 234 and prevent the flexible cleaning pad 210 from blocking the open channels 226, 228, 230, 232, 234. For the purposes of clarity only a few of the pad supports 252 are labelled in FIG. 16. In some embodiments the pad supports 252 can be any shape or size. In some embodiments a plurality of pad supports 252 optionally have a surface which is in the same plane. The plane of the surfaces of the pad supports 252 is the underside surface of the base 108.

The open channel portion 222 is configured to abut the flexible cleaning element 160. In this way when the flexible cleaning element 160 or the surface to be cleaned is adjacent to the open channel portion 222, the steam is guided from the internal bore portion 221 and across the matrix of open channels. The open side of the open channel portion 222, that is the side facing the flexible cleaning element 160 becomes the steam outlet 120. In addition the steam will also be outputted at the end of each open channel 226, 228, 230, 232, 234 at the front portion 236 and the sides of the steam cleaning accessory 20.

The steam cleaning accessory 20 has an inherent directionality. The user inserts their hand into the flexible pocket 140 at a rear portion 238 of the steam cleaning accessory 20. The user's fingers are inserted into the flexible pocket 140 and face towards a front portion 236 of the steam cleaning accessory 20. All the previously describe embodiments comprises a similar directionality. The rear portion 238 of the steam cleaning accessory 20 is bounded by a rear wall 242. The front portion 236 of the steam cleaning accessory 20 is bounded by a front wall 244. In some embodiments the peripheral wall 200 is curvilinear and the front wall 244 and the first and second side walls 104, 106 part of the same peripheral wall 200. In some embodiments (not shown) the front wall 244 and the first and second side walls 104, 106 can join at a corner.

A problem can arise if one or more of the steam outlets 120 is blocked and the steam backs up in the steam cleaning accessory 20. In this case the steam can travel backwards towards the wrist of the user. For example the user could squash the steam cleaning accessory 20 by pressing down hard blocking some of the steam outlets 120. Similarly if the flow rate of the steam which is outputted from the steam outlet 120 is low, then the steam can collect and also flow towards the rear of the steam cleaning accessory 20. If the steam contacts the skin of the user, for example, around the wrist, it is possible that the user may receive a steam burn.

The flexible body 102 comprises a barrier 240 projecting from the flexible body 102 which is engageable with the surface to be cleaned. The barrier 240 is located on a rear wall 242 side of the first and second steam holes 223, 224. This means that the barrier is located closer to the rear wall 242 on the underside of the flexible body 102 that the steam outlets 120. As mentioned previously there can be one steam outlet or a plurality of steam outlets 120. In embodiments where there are a plurality of steam outlets 120, the barrier 240 is mounted on rear wall 242 side on the flexible body 102 of the rearmost located steam outlet 120.

The barrier 240 projects downwardly from the base 108. In this way the barrier 240 stands proud from the underside surface of the base 108. The barrier 240 comprises a ramp portion 246 and a step portion 248. This means that the barrier 204 is arranged to contact the surfaced to be cleaned before any other part of the base 108 in the vicinity of the steam holes 223, 224. In some embodiments the barrier 240 can be and shape or form suitable for engaging the surface to be cleaned whilst preventing or limiting rearwards flow of the steam. In some embodiments the barrier 240 projects downwardly from the base 108 more than any other portion of the steam cleaning accessory 20.

The barrier 240 is a raised portion which extends substantially across the width of the steam cleaning accessory 20. The barrier 240 as shown in FIGS. 14 to 17 extends across the entire of the underside of the base 108. In other embodiments the barrier 240 can extend across a portion of the underside of the base 108. In some embodiments the barrier 240 is integral with the flexible body 102. In this way the barrier 240 is made from silicone or other similar material as the flexible body 102. In some other embodiments the barrier 240 can be made from rubber, an elastomeric material or any other polymeric material. Alternatively the barrier 240 is a separate element mountable on the flexible body 102. The barrier 240 can be fastened to the flexible body 102 with adhesive or a portion which is overmoulded on the flexible body 102. The barrier 240 is resiliently deformable and can shape to the contours of the surface to be cleaned. This advantageously can limited the rearward flow of steam towards the user's wrist.

FIG. 16 shows that the barrier 240 completely extends across the width of the underside of the base 108 of the steam cleaning accessory 20. This means that barrier 240 is configured to seal against the surface to be cleaned. In some embodiments the seal between the barrier 240 and the surface may not be steam tight, especially if the surface is non-flat. Alternatively, in some embodiments the barrier 240 may extend substantially across the underside of the base 108 of the steam cleaning accessory 20. In this way the barrier 240 guides the steam forwards towards the front portion 236 of the steam cleaning accessory 20. The barrier 240 may not seal against the surface to be cleaned, but instead guides the steam away from the rear of the steam cleaning accessory 20. The barrier 240 causes the path of least resistance for the steam to be along the open channels 226, 228, 230, 232, 234 and towards the peripheral wall 200 of the steam cleaning accessory 20.

By placing the barrier 240 adjacent to one or more steam holes 223, 224, then the barrier 240 acts as a baffle and inhibits the flow of steam rearwardly towards the user's wrist.

The flexible body 102 comprises a rearwardly projecting wrist guard 280. The wrist guard 280 projects from the rear of the flexible body 102 from the rear wall 242. The wrist guard 280 is located above the adaptor 24 and below the flexible pocket 140. The wrist guard 280 shields the opening 290 of the flexible pocket 140 from any steam that may escape from the adaptor 24 if the adaptor 24 is poorly fitted or removed from the steam hose. The wrist guard 280 extends rearwardly further than the opening 290 of the flexible pocket. This means that the user's wrist will either be shielded by the wrist guard 280 or the flexible pocket 140 from steam accidentally leaked from the adaptor. The wrist guard 280 shown in FIGS. 14 to 18 is a substantially planar member. However in other embodiments the wrist guard 280 can be curved upward to wrap around the user's wrist. Additionally or alternatively the wrist guard 280 can be a cuff which completely surrounds the user's wrist.

Optionally the barrier 240 is aligned with the heel of a user's hand when the user's hand is received within the flexible pocket 140. This means that the user naturally presses the barrier 240 against the surface to be cleaned, presenting a barrier to the steam.

Optionally the flexible cleaning element 160 is mounted on the steam cleaning accessory 20 such that the flexible cleaning pad 210 is adjacent to the barrier 240. The flexible cleaning pad 210 is located forwards of the barrier 240. The barrier 240 does not compress as easily as the flexible cleaning pad 210. This means that when the user presses the steam cleaning accessory 20 down on a surface to be cleaned, the barrier 240 will engage the surface and the flexible pad 210 will compress slightly into the base 108 of the steam cleaning accessory 20.

Figure 17:
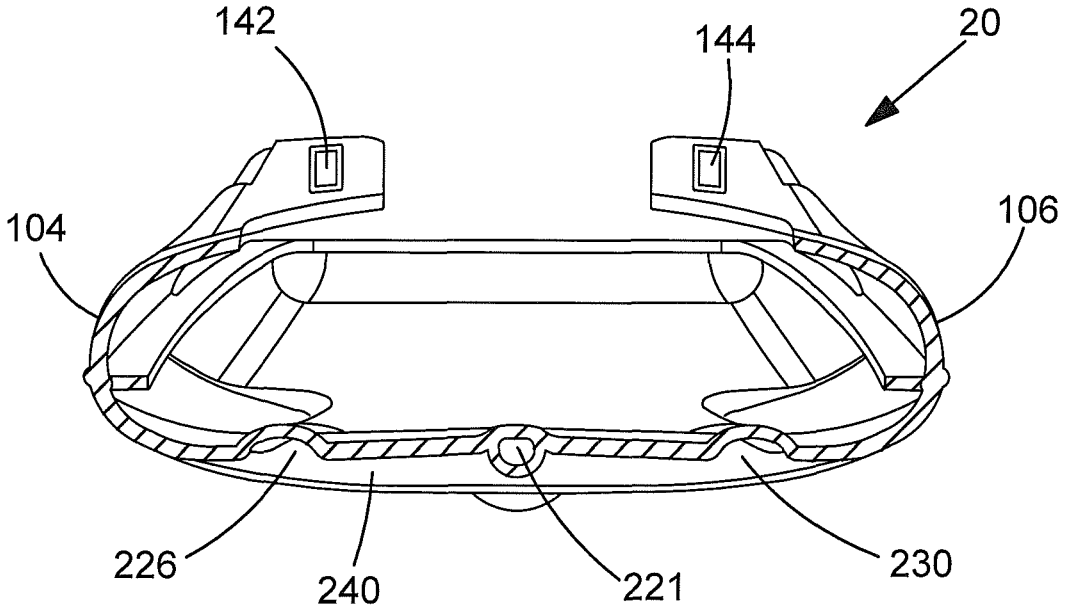
FIG. 17 shows a front cross sectional view of the steam cleaning accessory along the line C-C.

FIG. 17 shows a cross section of the steam cleaning accessory 20 along line C-C shown in FIGS. 14 to 16. Apart from the bottom of the adaptor 24, the barrier 240 is the lowest protruding element. In other embodiments the barrier 240 is the most downwardly projecting element.

Figure 18:
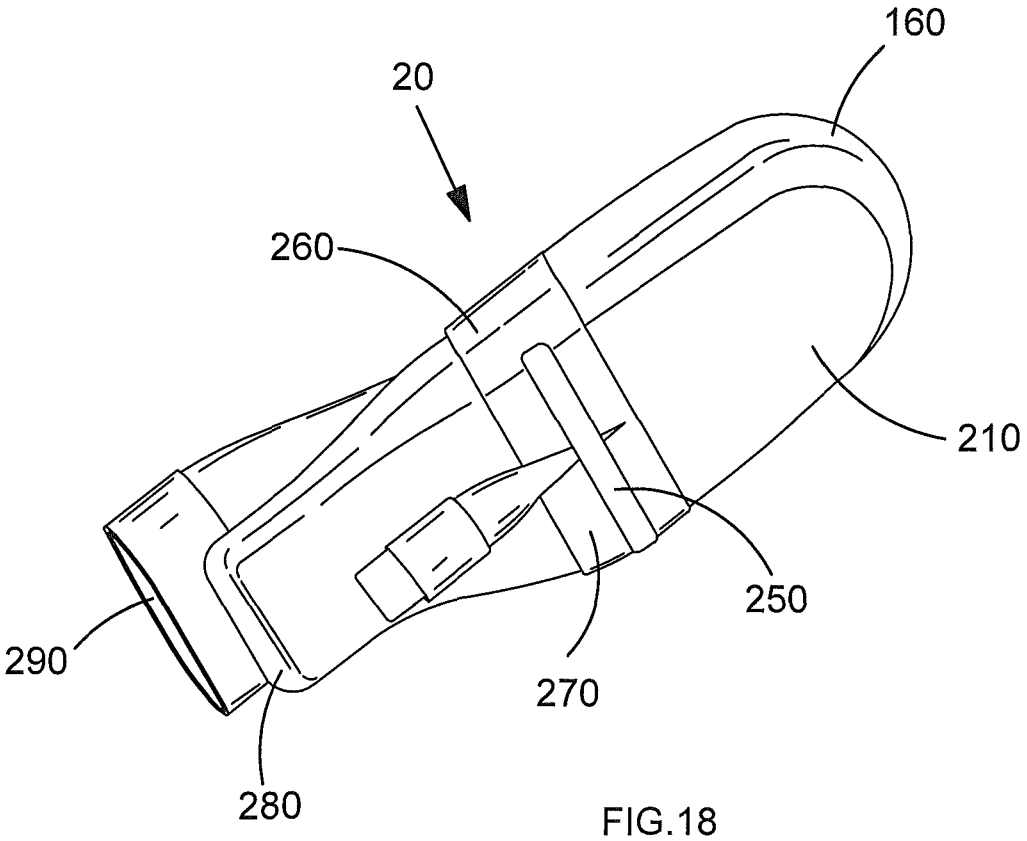
FIG. 18 shows a perspective view of a steam cleaning accessory according to an embodiment.

Another embodiment will now be discussed in reference to FIG. 18. FIG. 18 shows a perspective view of the steam cleaning accessory 20. The steam cleaning accessory 20 is the same as shown in FIGS. 14 to 17 except that the form of the barrier 250 has been modified. The barrier is an upstanding rib 250 which performs the same function of barrier 240 in the previous embodiments limiting the rearwards flow of the steam towards the user's wrist. The barrier 250 extends across a portion of the underside of the base 108. In other embodiments the barrier 240, 250 can be a projecting element which immediately surrounds the steam outlet 120, but does not extend to the edges of the flexible body 102. For example the barrier 240, 250 can be a rib member which has a U shape and the open end of the U faces the forward portion 235 of the flexible body 102. In this embodiment the steam will be guided toward the front portion 236 of the steam cleaning accessory 20.

The flexible cleaning element 160 is mounted on the steam cleaning accessory 20 and the flexible pad 210 covers the underside of the base 108. The flexible pad 210 covers the steam outlet 120. The upstanding rib 250 provides a securing means for the flexible cleaning element 160. The flexible cleaning element 160 comprises a securing strap 260 with a slot 270 for receiving the rib 250. When the rib 250 protrudes through the slot 270, the rib 250 prevents relative longitudinal movement of the flexible cleaning element 160 with respect to the flexible body 102. Optionally the flexible cleaning element 160 may also be mounted to the steam cleaning accessory 20 with other means as discussed in reference to previous embodiments (e.g. a hook and loop fabric fastener).

Although not shown in the embodiments discussed in FIGS. 1 to 13, either the barrier 240 and/or upstanding rib 250, as discussed in reference to embodiments shown in FIGS. 14 to 18, can be mounted on to the underside of the steam cleaning accessory 20 as shown in FIGS. 1 to 13. In some embodiments the flexible cleaning element 160, 32 can cover the entire underside of the steam cleaning accessory 20. In this case the barrier 240 can be mounted to the underside of the flexible cleaning element. Indeed the barrier 240 when described with respect to the embodiments shown in FIGS. 14 to 18 can be mounted to the flexible cleaning element 160. In some embodiments a first barrier 240 can be mounted on the flexible body 102 and a second barrier (not shown) can be mounted on the flexible cleaning element 160.

In another embodiment two or more embodiments are combined. Features of one embodiment can be combined with features of other embodiments.

Embodiments of the present invention have been discussed with particular reference to the examples illustrated. However it will be appreciated that variations and modifications may be made to the examples described within the scope of the invention.

The invention claimed is:

1. A steam cleaning accessory for use with a steam generator comprising:

a flexible body comprising a front wall, a rear wall and a base extending there between;

at least one steam conduit connectable to the steam generator and arranged to be in fluid communication therewith, wherein the steam conduit comprises at least one steam outlet for ejecting steam and the at least one steam outlet is mounted on an underside of the base which is configured to be adjacent to a surface to be cleaned;

a flexible pocket mounted on the flexible body and arranged to receive a user's hand; and a barrier projecting from the flexible body which is engageable with the surface to be cleaned, the barrier being located on a rear wall side of the at least one steam outlet.

2. The steam cleaning accessory according to claim 1 wherein the barrier extends substantially across the width of the underside of flexible body.

3. The steam cleaning accessory according to claim 1 wherein the barrier is integral with the flexible body.

4. The steam cleaning accessory according to claim 1 wherein the barrier is arranged to be substantially aligned with the heel of a user's hand when the user's hand is received in the flexible pocket.

5. The steam cleaning accessory according to claim 1 wherein the barrier is arranged to seal against the surface to be cleaned.

6. The steam cleaning accessory according to claim 1 wherein the barrier is made from silicone.

7. The steam cleaning accessory according to claim 1 comprising an adaptor in fluid communication with the at least one steam conduit and the adaptor is connectable with a steam hose or the steam generator and the adaptor is mounted on the flexible body on the rear wall side of the barrier.

8. The steam cleaning accessory according to claim 1 wherein the flexible body comprises a rearwardly projecting wrist guard.

9. The steam cleaning accessory according to claim 8 wherein the wrist guard is integrally moulded with the flexible body.

10. The steam cleaning accessory according to claim 8 wherein the wrist guard is between the adaptor and the opening of the flexible pocket.

11. The steam cleaning accessory according to claim 1 comprising a flexible insulating layer mounted between the base and the flexible pocket.

12. The steam cleaning accessory according to claim 1 wherein the flexible insulating layer is a resilient air permeable material.

13. The steam cleaning accessory according to claim 1 comprising a removable flexible cleaning element mountable on the flexible body.

14. The steam cleaning accessory according to claim 13 wherein the removable cleaning pad comprises a retention strap for mounting around the barrier for retaining the removable cleaning pad to the flexible body.

15. The steam cleaning accessory according to claim 1 operatively connected to a steam generator.

* * * * *